US007505004B2

(12) United States Patent
Chen et al.

(10) Patent No.: US 7,505,004 B2
(45) Date of Patent: Mar. 17, 2009

(54) BROADBAND ANTENNA

(75) Inventors: Chih Lung Chen, Taipei Hsien (TW); Chih Kai Liu, Taipei Hsien (TW)

(73) Assignee: Wistron Neweb Corporation, Taipei Hsien (TW)

( * ) Notice: Subject to any disclaimer, the term of this patent is extended or adjusted under 35 U.S.C. 154(b) by 169 days.

(21) Appl. No.: 11/257,317

(22) Filed: Oct. 25, 2005

(65) Prior Publication Data

US 2007/0013588 A1 Jan. 18, 2007

(30) Foreign Application Priority Data

Jul. 13, 2005 (TW) ..... 94211912 U

(51) Int. Cl.
*H01Q 1/24* (2006.01)

(52) U.S. Cl. ..... 343/702; 343/700 MS

(58) Field of Classification Search ..... 343/700 MS, 343/702, 846, 848
See application file for complete search history.

(56) References Cited

U.S. PATENT DOCUMENTS 6,002,367 A * 12/1999 Engblom et al. ..... 343/700 MS
6,107,967 A * 8/2000 Hill ..... 343/702
6,204,819 B1 * 3/2001 Hayes et al. ..... 343/702
6,313,798 B1 * 11/2001 Bancroft et al. ..... 343/700 MS
6,680,704 B2 * 1/2004 Cassel et al. ..... 343/700 MS
6,683,575 B2 * 1/2004 Sekine et al. ..... 343/702
6,861,986 B2 3/2005 Fang et al.
6,943,738 B1 * 9/2005 Mattsson et al. ..... 343/700 MS
7,034,754 B2 * 4/2006 Hung et al. ..... 343/700 MS
2004/0056804 A1 * 3/2004 Kadambi et al. ..... 343/700 MS
2005/0001768 A1 * 1/2005 Sekiguchi et al. ..... 343/700 MS
2005/0068234 A1 * 3/2005 Hung et al. ..... 343/702
2006/0038721 A1 * 2/2006 Ozkar et al. ..... 343/700 MS
2006/0082506 A1 * 4/2006 Fang ..... 343/700 MS
2006/0232482 A1 * 10/2006 Chen ..... 343/702

* cited by examiner

*Primary Examiner*—HoangAnh T Le
(74) *Attorney, Agent, or Firm*—Bacon & Thomas, PLLC

(57) ABSTRACT

A broadband antenna for wireless communication system, the broadband antenna includes a radiating element, a grounding element and a connecting element for connecting the radiating element and the grounding element. The radiating element has a U-shaped structure, a V-shaped structure or an L-shaped structure. The broadband antenna of the present invention has wider frequency bandwidth and higher antenna efficiency.

12 Claims, 10 Drawing Sheets

BROADBAND ANTENNA

BACKGROUND OF THE INVENTION

1. Field of the Invention

The present invention relates to an antenna, and more particularly, to a dual-band broadband antenna.

2. Description of the Related Art

With the developments in wireless communications technology, many electronic devices, such as notebooks and mobile phones, now incorporate wireless communications abilities. In order to receive and transmit signals, these electronic devices need to have an antenna for detecting electromagnetic wave.

Since both mobile phones and notebooks have became important in the daily lives of many people, if it were possible to combine these two devices, such a combined-function device would offer significantly more convenience for users. However, the prior art antennas for typical mobile phones usually have a frequency bandwidth of about 70 MHz at a low frequency range (900 MHz), and a frequency bandwidth of about 120 MHz at a high frequency range (1800 MHz) when a VSWR (Voltage Standing Wave Ratio) is less than 4. Additionally, the antenna efficiency of the typical mobile phones is typically around 20~30%; therefore, if the prior art mobile phone antenna is installed in a notebook, the antenna will not provide very satisfactory results.

A prior art technology has disclosed a dual-band antenna that can provide a wider frequency bandwidth than earlier mobile phone antennas. Please refer to FIG. 1. FIG. 1 shows a prior art antenna 90, as disclosed in U.S. Pat. No. 6,861,986. The antenna 90 can be used for WWAN, WLAN 802.11a or 802.11b, Bluetooth or GSM communications systems. Compared to the typical mobile phone antenna, the antenna 90 has a wider frequency bandwidth, usually having a frequency bandwidth of about 120 MHz at the low frequency range (900 MHz) and a frequency bandwidth of about 480 MHz at the high frequency range (1800 MHz) when the VSWR is less than 3.

Although the prior art technology already provides a broadband antenna, the frequency bandwidth still can be improved. Furthermore, if a new antenna can provide a wider frequency bandwidth with a smaller size, such a new antenna would have better platform compatibility characteristics, and would have lower manufacturing costs.

Therefore, it is desirable to provide a dual-band broadband antenna to mitigate and/or obviate the aforementioned problems.

SUMMARY OF THE INVENTION

An objective of the present invention is to provide a broadband antenna with wider frequency bandwidth. The broadband antenna with a U-shaped structure of the present invention has a radiating element with a U-shaped structure, a grounding element and a connecting element. The radiating element has a first metal plane, a second metal plane and a third metal plane to form the U-shaped structure. When the VSWR is less than 3, this broadband antenna with the U-shaped structure has a frequency bandwidth of about 300 MHz at a low frequency range (900 MHz), a frequency bandwidth of about 550 MHz at a high frequency range (1800 MHz), and its antenna efficiency is about 40~50%.

The present invention also provides a broadband antenna with a V-shaped structure. The broadband antenna with the V-shaped structure of the present invention has a radiating element with a V-shaped structure, a grounding element and a connecting element. The radiating element has a first metal plane and a second metal plane to form the V-shaped structure.

The present invention also provides a broadband antenna with an L-shaped structure. The broadband antenna with the L-shaped structure of the present invention has a radiating element with an L-shaped structure, a grounding element and a connecting element. The radiating element has a first metal plane and a second metal plane to form the L-shaped structure.

The above-mentioned broadband antenna with the V-shaped structure and the broadband antenna with the L-shaped structure both can provide wider frequency bandwidth.

Other objects, advantages, and novel features of the invention will become more apparent from the following detailed description when taken in conjunction with the accompanying drawings.

DETAILED DESCRIPTION OF THE PREFERRED EMBODIMENT

Figure 2:
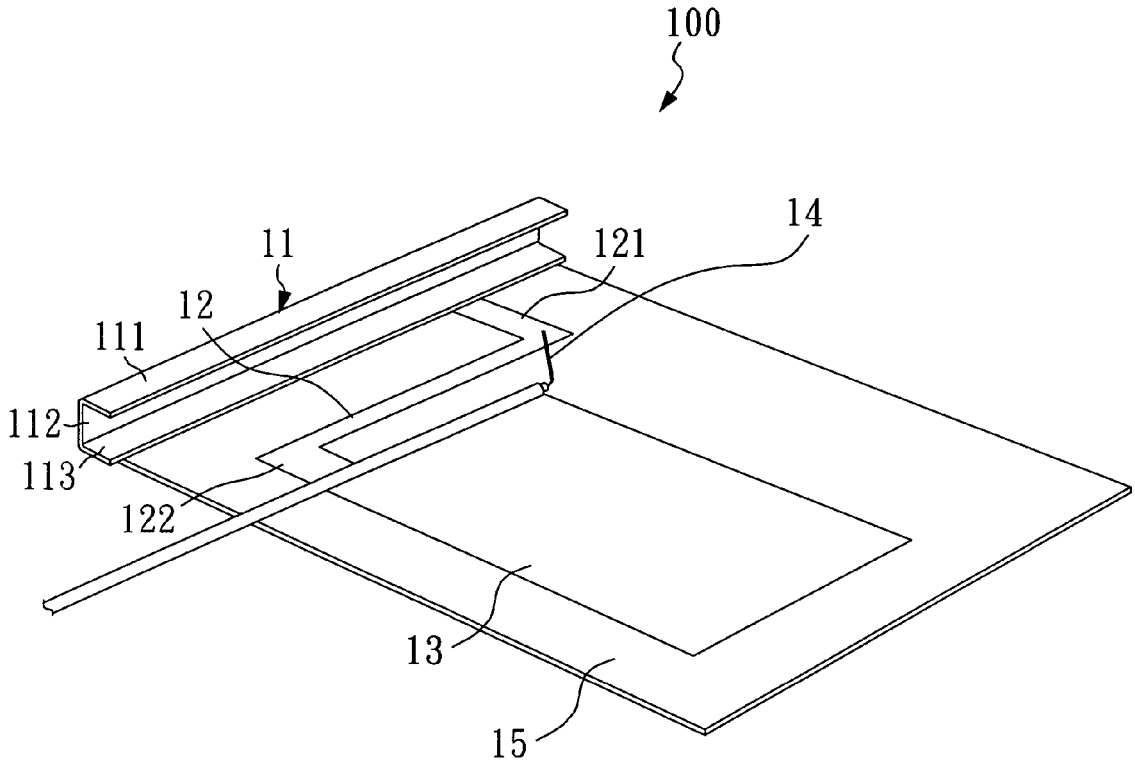
FIG. 2 is a schematic drawing of a broadband antenna according to a first embodiment of the present invention.

Please refer to FIG. 2. FIG. 2 is a schematic drawing of a broadband antenna according to a first embodiment of the present invention. As shown in the drawing, in the first embodiment, the broadband antenna 100 comprises a radiating element 11, a connecting element 12, a grounding element 13, a feed line 14 and a PCB (printed circuit board) 15.

The connecting element 12 has a first end 121 and a second end 122. The first end 121 is electrically connected between the two ends of the radiating element 11, which has a U-shaped structure, and the second end 122 is electrically connected to grounding element 13. The connecting element 12 and the grounding element 13 are both mounted on the PCB 15. One end of the feed line 14 is electrically connected to the first end 121 of the connecting element 12 and the other end of the feed line 14 is electrically connected to a radio receiving/transmitting device (not shown) to electrically connect the radiating element 11 to the radio receiving/transmitting device, and to use the radiating element 11 to receive or transmit electromagnetic wave. Since the connecting element 12, the grounding element 13, the feed line 14 and the PCB 15 are all very well-known elements, they require no further description.

Figure 1:
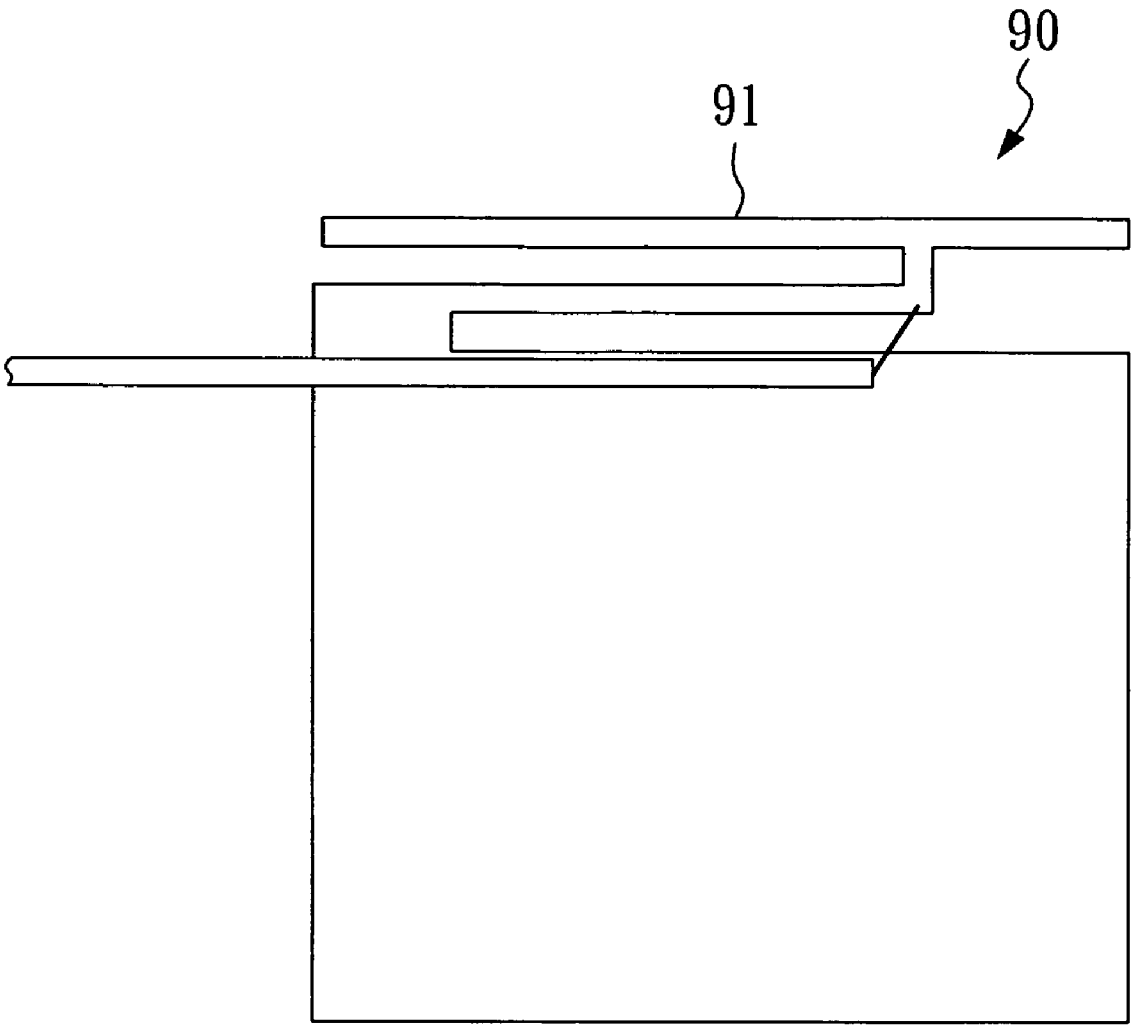
FIG. 1 is a schematic drawing of a prior art broadband antenna.

As shown in FIG. 2, one main difference between the broadband antenna 100 of the present invention and the prior art antenna 90 is the replacement of the radiating element 91, which has a straight line-shaped structure (as shown in FIG. 1), by the radiating element 11 that has a U-shaped structure.

As shown in FIG. 2, the radiating element 11 comprises a quadrilateral first metal plane 111, a second metal plane 112 and a third metal plane 113. The first metal plane 111 and the second metal plane 112 are connected to each other, and the second metal plane 112 and the third metal plane 113 are also connected to each other to form a U-shaped structure. The first metal plane 11 1 and the third metal plane 113 are parallel with the surface that the grounding element 13 and the PCB 15 are positioned onto; the second metal plane 112 is perpendicular with the surface that the grounding element 13 and the PCB 15 are positioned onto, and so an opening of the U-shaped structure of the radiating element 11 is parallel with the grounding element 13 and the PCB 15.

Figure 3:
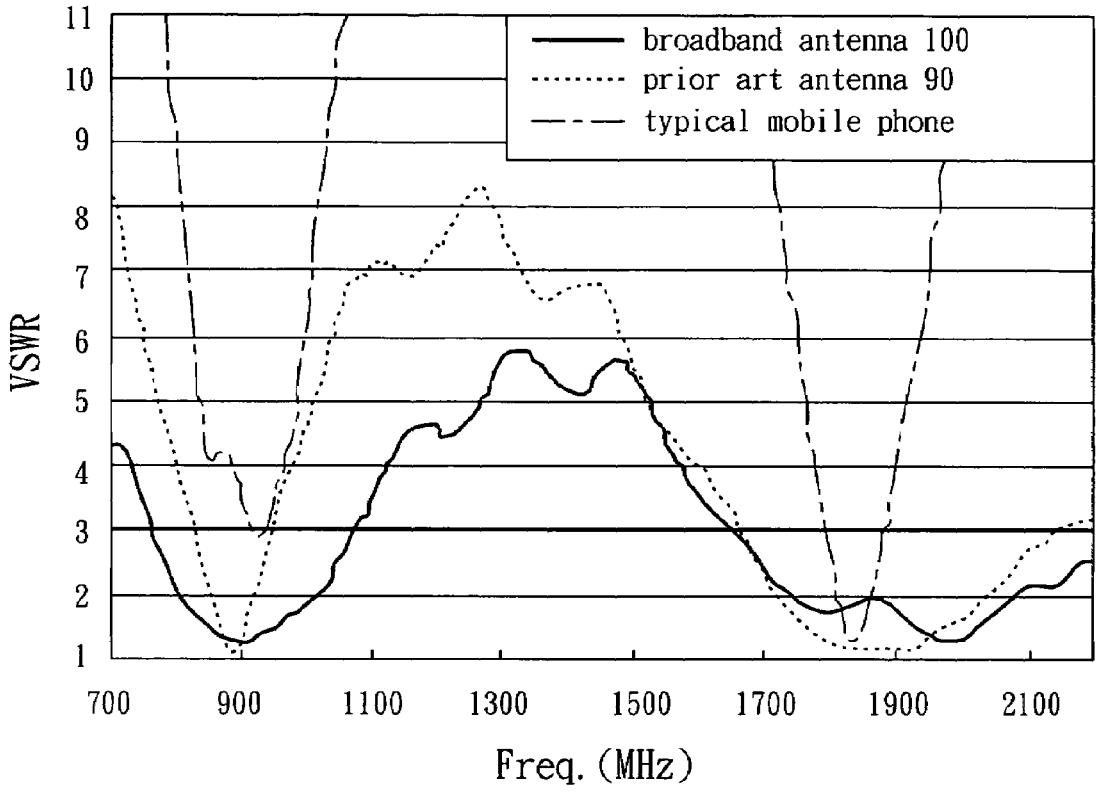
FIG. 3 shows different frequency bandwidths of different antennas.

Compared to the prior art, the broadband antenna 100 has not only a dual-band but also a wider frequency bandwidth. Please refer to FIG. 3. FIG. 3 shows the frequency response of a typical mobile phone, the prior art antenna 90, and the broadband antenna 100 of the present invention with respect to the VSWR.

In FIG. 3, when the VSWR is less than 3, the typical mobile phone has the most narrow frequency bandwidth; its frequency bandwidth in the low frequency range (900 MHz) is about 10 MHz, and the frequency bandwidth in the high frequency range (1800 MHz) is about 100 MHz. The prior art antenna 90 has a wider frequency bandwidth, with a frequency bandwidth in the low frequency range (900 MHz) of about 120 MHz, and a frequency bandwidth in the high frequency range (1800 MHz) of about 480 MHz. The broadband antenna 100 of the present invention has the widest frequency bandwidth, with a frequency bandwidth in the low frequency range (900 MHz) of about 300 MHz, and a frequency bandwidth in the high frequency range (1800 MHz) of about 550 MHz. It is clear that the broadband antenna 100 of the present invention has a wider frequency bandwidth, and a better efficiency, than the typical mobile phone and the prior art antenna 90.

Figure 4A:
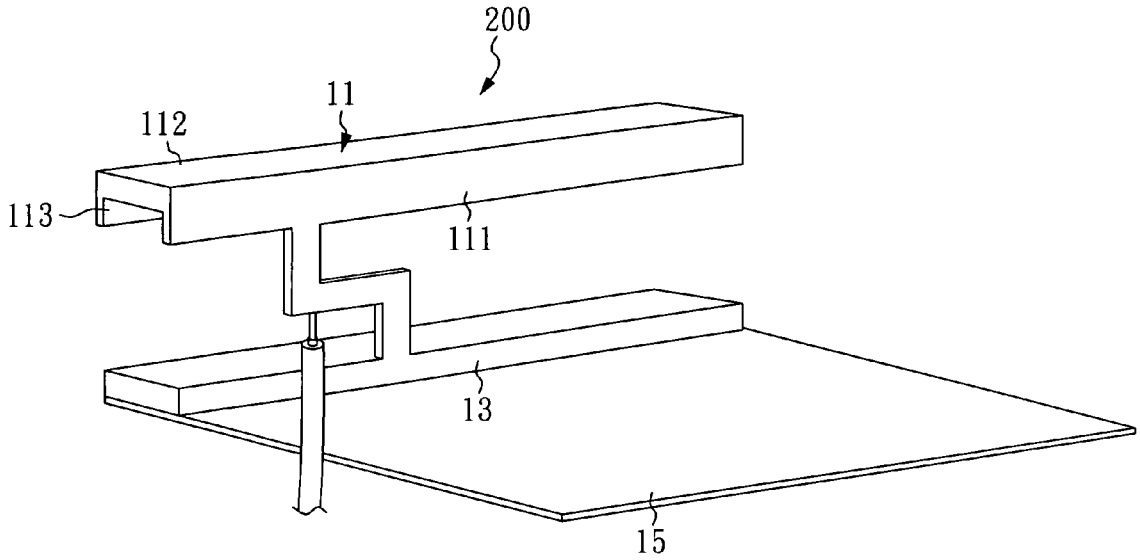
FIG. 4 is a schematic drawing of a broadband antenna according to a second embodiment of the present invention.
Figure 4B:
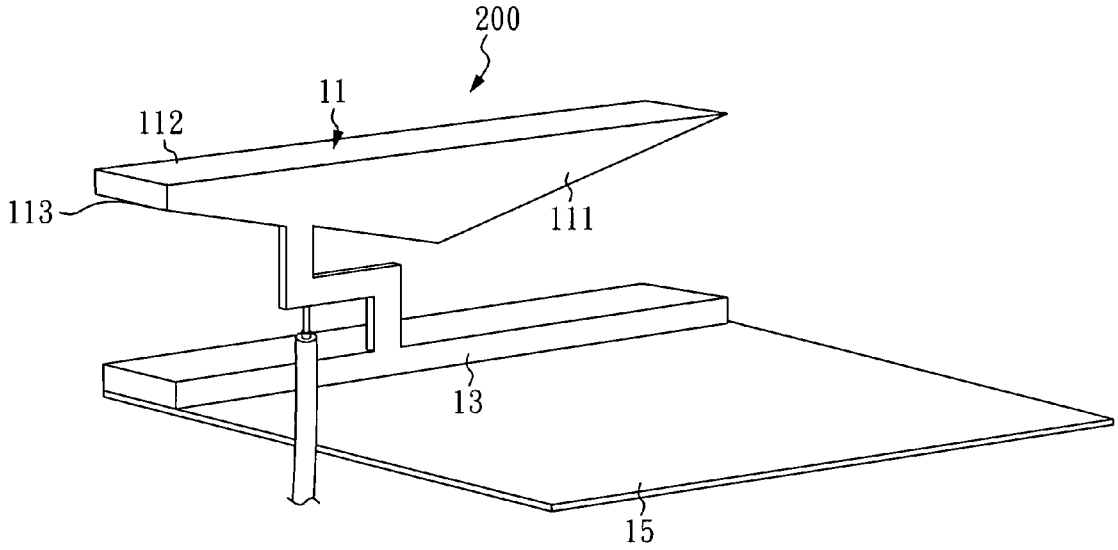
Figure 4C:
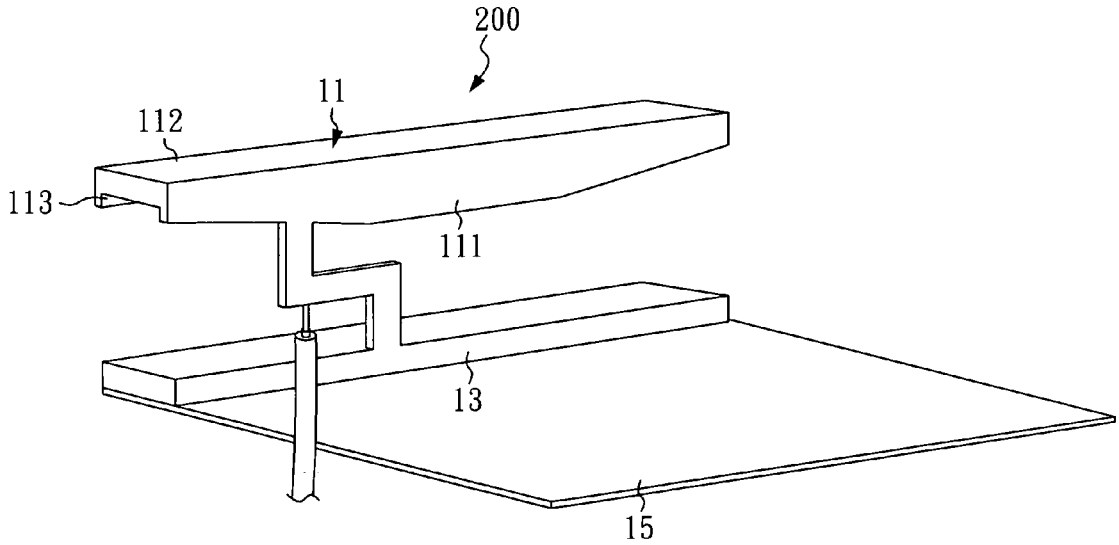

Please refer to FIG. 4A. FIG. 4A is a schematic drawing of a broadband antenna according to a second embodiment of the present invention. As shown in the drawing, the main difference between the broadband antenna 200 in the second embodiment and the broadband antenna 100 in the first embodiment is that, in the second embodiment, the first metal plane 111 and the third metal plane 113 are perpendicular to the grounding element 13, and the second metal plane 112 is parallel with the grounding element 13 so that the opening of the U-shaped structure of the radiating element 11 faces toward the grounding element 13. As shown in FIGS. 4B and 4C, the first metal plane 111 and the third metal plane 113 can be triangle shaped or pentagon shaped.

Figure 5:
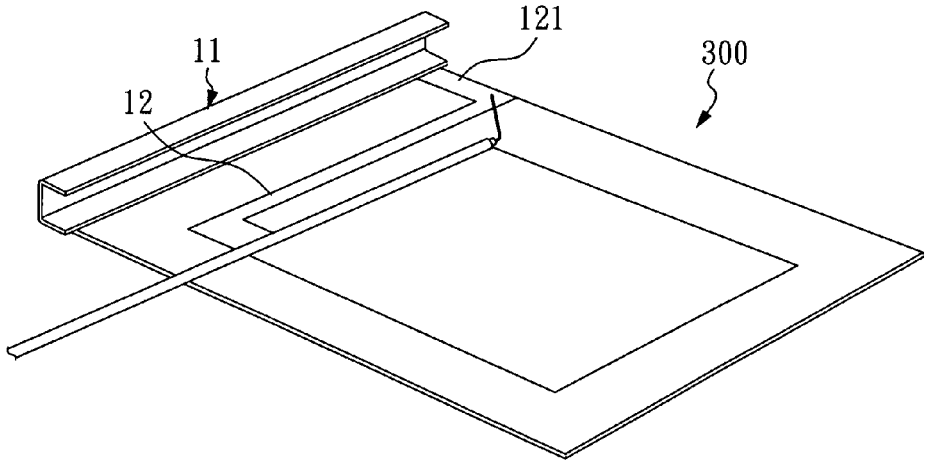
FIG. 5 is a schematic drawing of a broadband antenna according to a third embodiment of the present invention.

Please refer to FIG. 5. FIG. 5 is a schematic drawing of a broadband antenna according to a third embodiment of the present invention. As shown in the drawing, in the third embodiment, the main difference between the broadband antenna 300 in the third embodiment and the broadband antenna 100 in the first embodiment is that, in the third embodiment, the first end 121 of the connecting element 12 is electrically connected to one side of the radiating element 11 and not between the two ends of the radiating element 11. Therefore, the third embodiment of the present invention is capable of inducing a second resonance of 1800 MHz from 900 MHz, thus as to provide dual bands and broad bandwidth responses. Since induce dual bands technology is a well-known technology there will be no more description.

Figure 6:
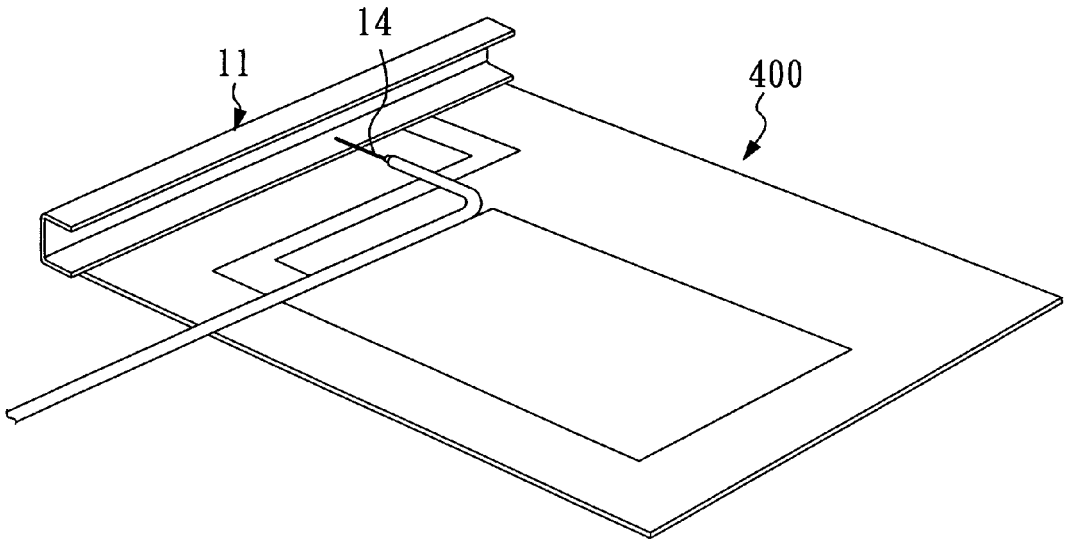
FIG. 6 is a schematic drawing of a broadband antenna according to a fourth embodiment of the present invention.

Please refer to FIG. 6. FIG. 6 is a schematic drawing of a broadband antenna according to a fourth embodiment of the present invention. As shown in the drawing, in the fourth embodiment, the feed line 14 in the broadband antenna 400 is directly connected to the radiating element 11 with the U-shaped structure and not to the first end 121 of the connecting element 12, as shown in FIG. 2. The broadband antenna 400 in the fourth embodiment of the present invention still provides a wide bandwidth, dual frequency response.

Figure 7:
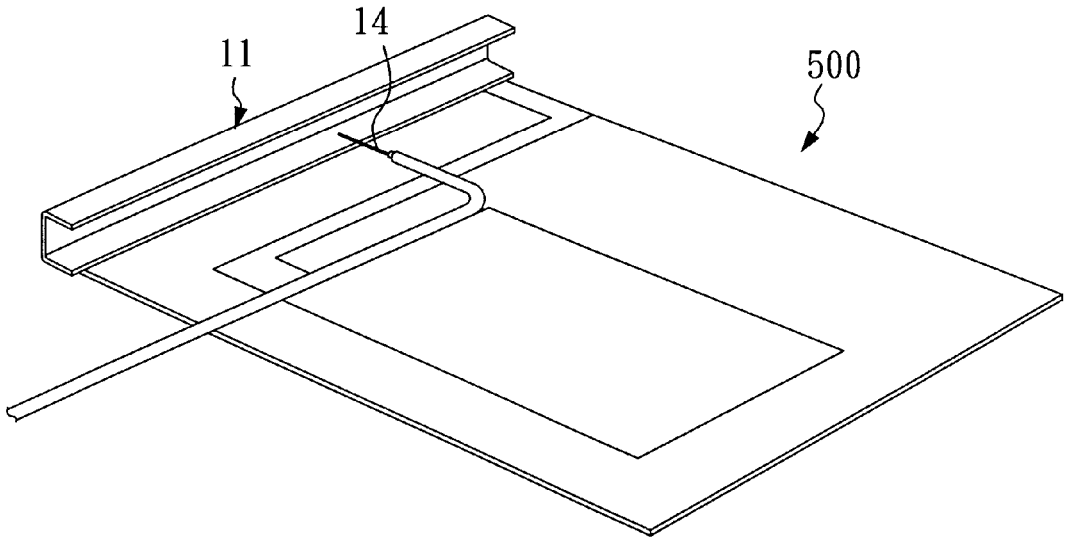
FIG. 7 is a schematic drawing of a broadband antenna according to a fifth embodiment of the present invention.

Please refer to FIG. 7. FIG. 7 is a schematic drawing of a broadband antenna according to a fifth embodiment of the present invention. As shown in the drawing, the feed line 14 of the broadband antenna 500 in the fifth embodiment of the present invention is directly connected to the radiating element 11 with the U-shaped structure, and not to the first end 121 of the connecting element 12, as shown in FIG. 5. In this way, the broadband antenna 500 of the fifth embodiment of the present invention still provides a wide bandwidth, dual frequency response.

Figure 8:
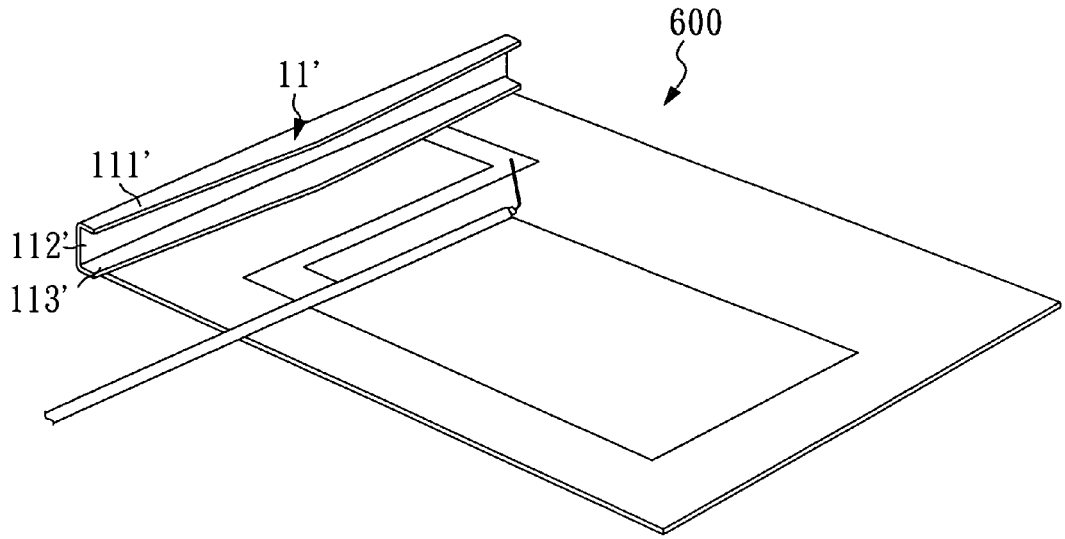
FIG. 8 is a schematic drawing of a broadband antenna according to a sixth embodiment of the present invention.
Figure 9:
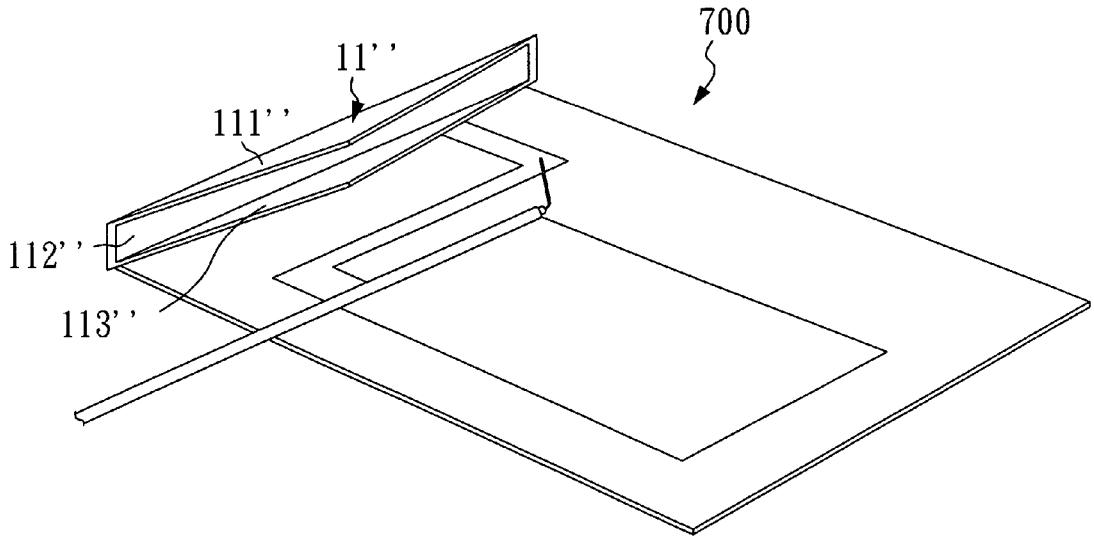
FIG. 9 is a schematic drawing of a broadband antenna according to a seventh embodiment of the present invention.

In the above-mentioned five embodiments, all three metal planes 111, 112, 113 of the radiating element 11 are quadrilateral, but this should not be construed as a limitation of the present invention. For example, as shown in FIG. 8, in a broadband antenna 600 of the sixth embodiment of the present invention, the broadband antenna 600 has a radiating element 11' having a second metal plane 112 with a quadrilateral shape, a first metal plane 111' and a third metal plane 113' both with a pentagonal shape; or as shown in FIG. 9, in a broadband antenna 700 of the seventh embodiment of the present invention, the broadband antenna 700 comprises radiating element 11" having a second metal plane 112" with a quadrilateral shape, a first metal plane 111" and a third metal plane 113" both with a triangular shape. In this manner, the present invention antennas still respectively provide a wide bandwidth, dual frequency response.

To reduce the size of the antenna, the radiating element 11 with the U-shaped structure can be altered to different shapes, such as a V-shaped structure or an L-shaped structure.

Figure 10:
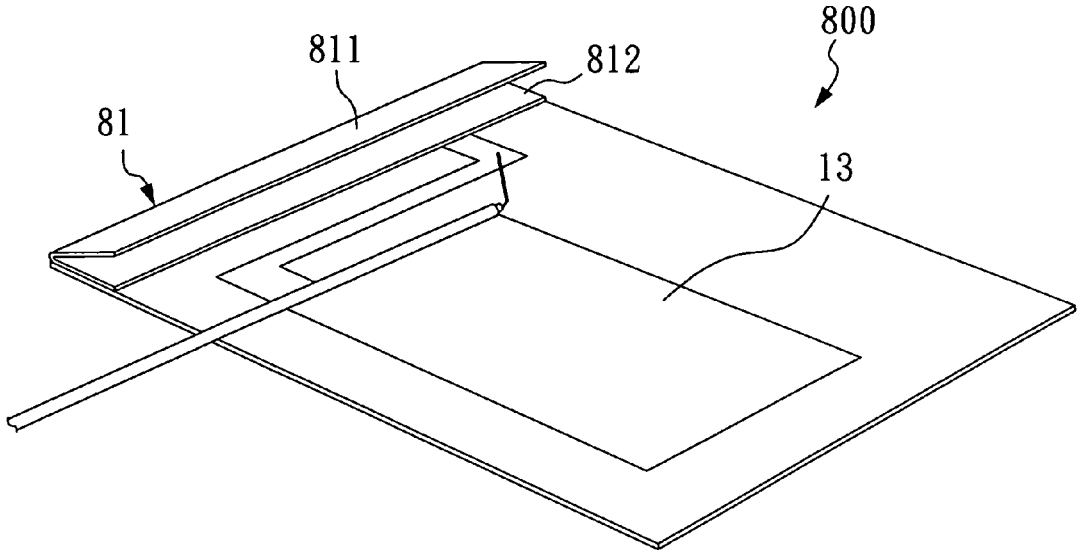
FIG. 10 is a schematic drawing of a broadband antenna according to an eighth embodiment of the present invention.

Please refer to FIG. 10. FIG. 10 is a schematic drawing of a broadband antenna according to an eighth embodiment of the present invention. As shown in FIG. 10, in a broadband antenna 800 of the eighth embodiment of the present invention, the radiating element 11 with the U-shaped structure in each of the first to seventh embodiments is replaced by a radiating element 81 with a V-shaped structure to reduce the size of the antenna. As shown in FIG. 10, the broadband antenna 800 comprises a radiating element 81 having a first metal plane 811 and a second metal plane 812 which form a V-shaped structure; and the opening of the radiating element 81' of the broadband antenna 800 faces toward the grounding element 13.

Figure 11:
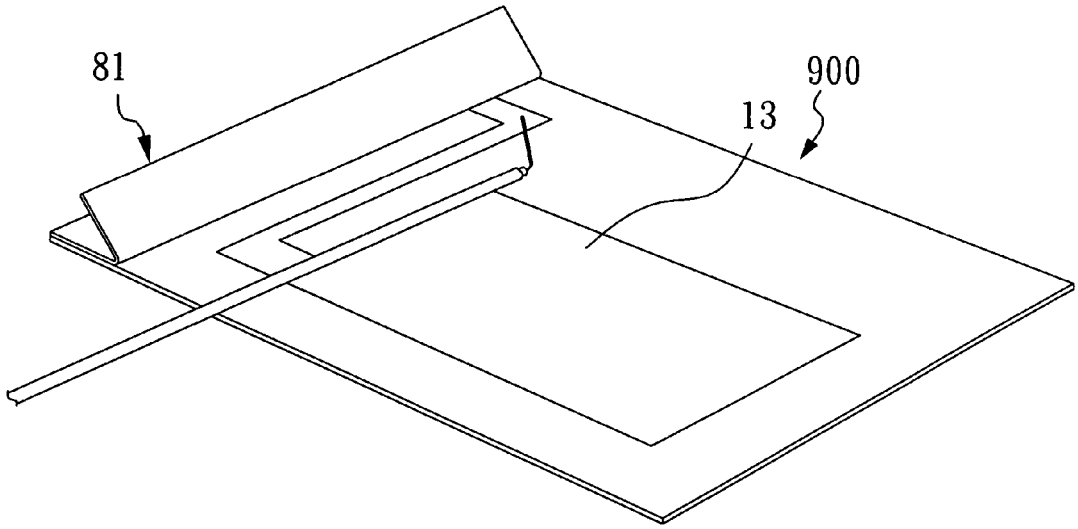
FIG. 11 is a schematic drawing of a broadband antenna according to a ninth embodiment of the present invention.

Please refer to FIG. 11. FIG. 11 is a schematic drawing of a broadband antenna according to a ninth embodiment of the present invention. As shown in the drawing, in a broadband antenna 900 of the ninth embodiment of the present invention, and the opening of the radiating element 81 with the V-shaped structure faces backward the grounding element 13. In this way, the present invention can still provide a wide bandwidth, dual frequency response.

Figure 12:
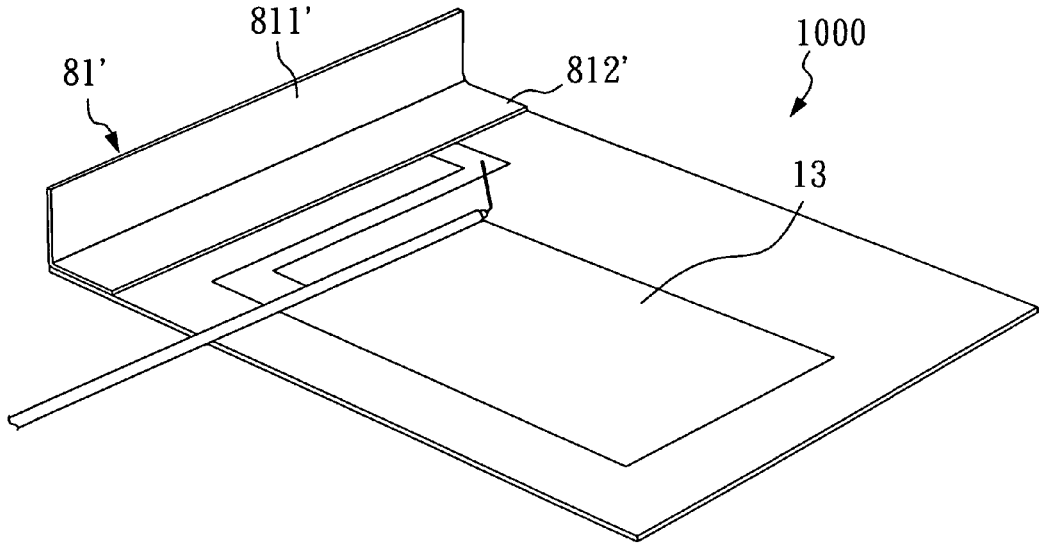
FIG. 12 is a schematic drawing of a broadband antenna according to a tenth embodiment of the present invention.

Please refer to FIG. 12. FIG. 12 is a schematic drawing of a broadband antenna according to a tenth embodiment of the present invention. As shown in the drawing, in a broadband antenna 1000 of the tenth embodiment of the present invention, the radiating element 11 with the U-shaped structure in the other embodiments is replaced by a radiating element 81' with an L-shaped structure to reduce the size of the antenna. As shown in FIG. 12, the broadband antenna 1000 comprises a radiating element 81' having a first metal plane 811' and a second metal plane 812' which form an L-shaped structure; and the opening of the radiating element 81 of the broadband antenna 1000 faces toward the grounding element 13.

Figure 13:
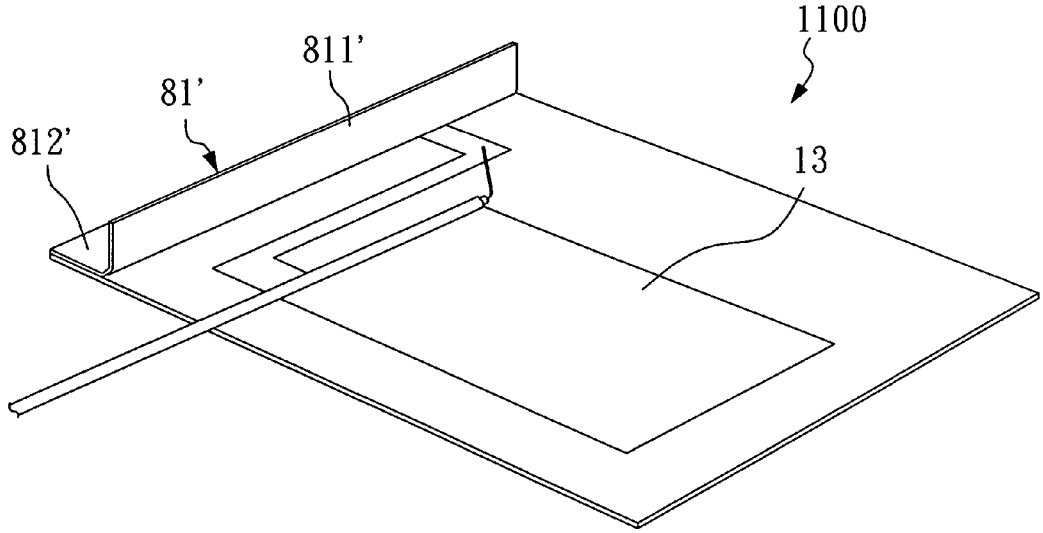
FIG. 13 is a schematic drawing of a broadband antenna according to an eleventh embodiment of the present invention.

Please refer to FIG. 13. FIG. 13 is a schematic drawing of a broadband antenna according to an eleventh embodiment of the present invention. As shown in the drawing, in a broadband antenna 1100 of the eleventh embodiment of the present invention, the opening of the radiating element 81' with the L-shaped structure faces backward the grounding element 13. In this way, the present invention can still provide a wide bandwidth, dual frequency response.

Figure 14:
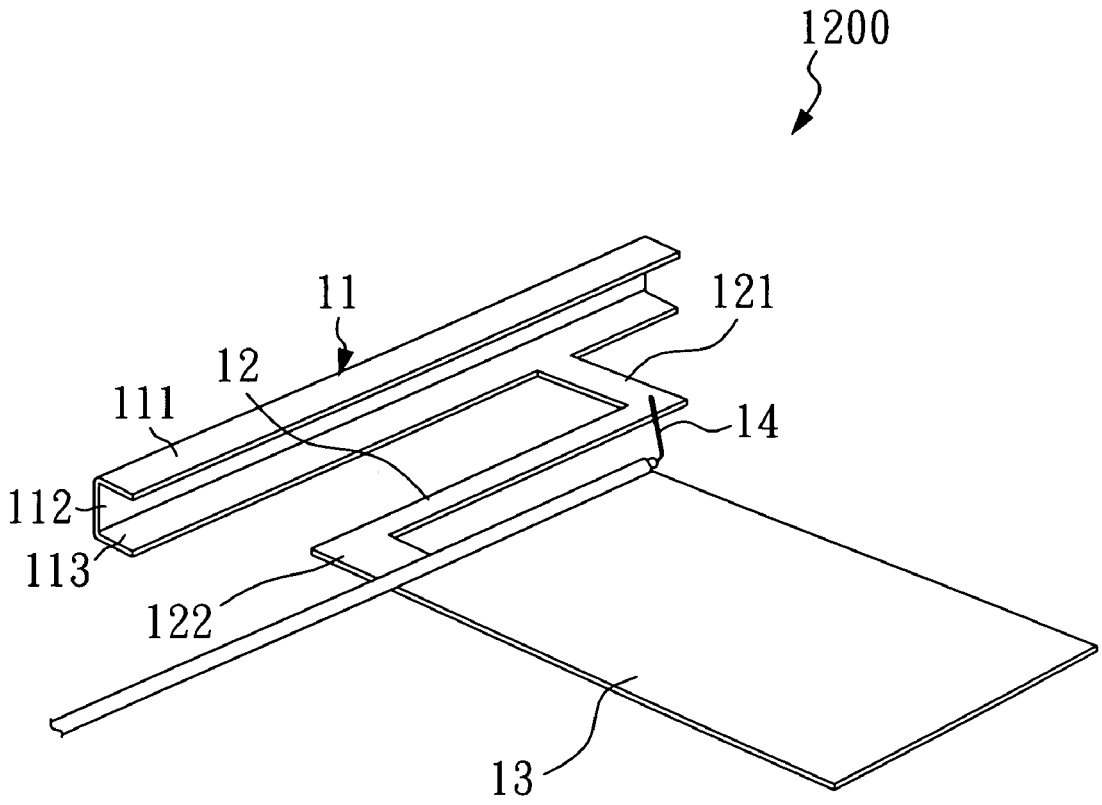
FIG. 14 is a schematic drawing of a broadband antenna according to a twelfth embodiment of the present invention.

In the above-mentioned embodiments, each radiating element 11, 11', 11", 81, 81' can either be disposed separately from or combined with the connecting element 12 as an integrated form to omit the PCB 15. For example, as shown in FIG. 14, in a broadband antenna 1200 of a twelfth embodiment of the present invention, the radiating element 11 with the U-shaped structure and the connecting element 12 in the first embodiment are disposed as a single identity. Similarly, radiating elements with other shapes can also be disposed with the connecting element as a single identity (not shown). In this way, the present invention can still provide a wide bandwidth, dual frequency response.

Although the present invention has been explained in relation to its preferred embodiment, it is to be understood that many other possible modifications and variations can be made without departing from the spirit and scope of the invention as hereinafter claimed.

What is claimed is:

1. A broadband antenna comprising: a radiating element having a first metal plane, a second metal plane and a third metal plane, wherein the first metal plane is connected to the second metal plane and the second metal plane is connected to the third metal plane, wherein the first metal plane is parallel with the third metal plane, and the second metal plane is perpendicular to the first metal plane and the third metal plane to form a U-shape structure;

a grounding element, wherein the first metal plane and the third metal plane are both parallel with the grounding element, and the second metal plane is perpendicular to the grounding element so an opening of the U- shaped structure faces toward the grounding element;

a connecting element having a first end and a second end, wherein the first end is electrically connected to the radiating element, and the second end is electrically connected to the grounding element; and a feed line, wherein the feed line is electrically connected to the first end of the connecting element.

2. The broadband antenna as claimed in claim 1 further comprising a PCB (printed circuit board), the connecting element and the grounding element both mounted on the PCB.

3. The broadband antenna as claimed in claim 1, wherein the radiating element and the connecting element are formed together as a single identity.

4. The broadband antenna as claimed in claim 1, wherein the first metal plane, the second metal plane or the third metal plane has a quadrilateral shape.

5. The broadband antenna as claimed in claim 1, wherein the second metal plane has a quadrilateral shape, and the first metal plane or the third metal plane has a pentagonal shape.

6. The broadband antenna as claimed in claim 1, wherein the second metal plane has a quadrilateral shape, and the first metal plane or the third metal plane has a triangular shape.

7. A broadband antenna comprising: a radiating element having a first metal plane, a second metal plane and a third metal plane, wherein the first metal plane is connected to the second metal plane and the second metal plane is connected to the third metal plane, wherein the first metal plane is parallel with the third metal plane, and the second metal plane is perpendicular to the first metal plane and the third metal plane to form a U-shape structure;

a grounding element, wherein the first metal plane and the third metal plane are both perpendicular to the grounding element, and the second metal plane is parallel to the grounding element so an opening of the U- shaped structure faces toward the grounding element;

a connecting element having a first end and a second end, wherein the first end is electrically connected to the radiating element, and the second end is electrically connected to the grounding element; and a feed line, wherein the feed line is electrically connected to the first end of the connecting element.

8. The broadband antenna as claimed in claim 7, further comprising a PCB (printed circuit board), grounding element mounted on the PCD.

9. The broadband antenna as claimed in claim 7, wherein the radiating element and the connecting element are formed together as a single identity.

10. The broadband antenna as claimed in claim 7, wherein the first metal plane, the second metal plane or the third metal plane has a quadrilateral shape.

11. The broadband antenna as claimed in claim 7, wherein the second metal plane has a quadrilateral shape, and the first metal plane or the third metal plane has a pentagonal shape.

12. The broadband antenna as claimed in claim 7, wherein the second metal plane has a quadrilateral shape, and the first metal plane or the third metal plane has a triangular shape.

* * * * *